United States Patent [19]

So

[11] Patent Number: 4,965,898

[45] Date of Patent: Oct. 30, 1990

[54] INNOVATIVE STRUCTURE OF CUSHION

[76] Inventor: Chen Y. So, No. 359, Hua Hsing St., Chu Pei Town, Hsing Chu County, Taiwan

[21] Appl. No.: 427,488

[22] Filed: Oct. 27, 1989

[51] Int. Cl.[5] ..... A47C 27/00

[52] U.S. Cl. ..... 5/468; 5/258; 5/448; 5/246; 297/452

[58] Field of Search ..... 5/448, 431, 446, 447, 5/258, 468, 246–248, 475; 297/452

[56] References Cited

U.S. PATENT DOCUMENTS

| | | | |
|---|---|---|---|
| 51,981 | 1/1966 | Todd | 5/258 |
| 97,579 | 12/1969 | Wittram | 5/258 |
| 958,356 | 5/1910 | Bode | 5/447 |
| 4,628,555 | 12/1986 | Forster | 5/258 |

FOREIGN PATENT DOCUMENTS

| | | | |
|---|---|---|---|
| 8555 | of 1894 | United Kingdom | 5/258 |

*Primary Examiner*—Alexander Grosz

*Attorney, Agent, or Firm*—Morton J. Rosenberg; David I. Klein

[57] ABSTRACT

The present invention is related to a new cushion structure generally comprised of a plurality of spring plates each having respectively mounted thereon a pair of smooth spherical elements. Responsive to an individual sitting on the cushion, the spherical elements in the area where the individual is seated are displaced to cause the spring plates to further incline rearwardly one after another. Through this chain reaction, the spring plates in the area of the individual will all be displaced rearwardly to perfectly fit the curvature of the individual's body who sits thereon. In addition to providing a good ventilation effect, the spring plates which are made of a metal material, also serve to eliminate concentrations of heat in the area where the individual is sitting by virtue of their heat conduction.

2 Claims, 5 Drawing Sheets

INNOVATIVE STRUCTURE OF CUSHION

BACKGROUND OF THE INVENTION

The present invention is related to an innovative structure of a cushion having an upper surface area comprised of a plurality of smooth spherical elements flexibly supported by spring means to provide a good ventilation effect and means to prefectly fit the curvature of a person's body who sits or lies thereon.

Conventional cushions are normally made of a sponge composition or other suitable stuffing materials covered with a protective leather cover, making it very difficult for air to pass through. The poor ventilation effect of conventional cushions makes them impractical for use in summer months because heat will concentrate at the area where one is seated and thereby make one feel uncomfortable.

Conventional sofas and wire mattresses are normally supported by means of compression springs to make the structure more flexible and comfortable. However, these sofas and wire mattresses are not practical for use in the summer because they generally include a cover which resticts ventilation therethrough and limits heat transfer by radiation. Therefore, some people would prefer to sleep on a sleeping mat or mattress made of straw, or bamboo during the summer season to overcome this problem. Although any sleeping mat or mattress which is made of straw or bamboo is very practical in terms of permitting air to pass through and to thereby provide good ventilation, however, the structure of such mats are very stiff, and not sufficiently flexible to fit the curvature of the human body.

It is therefore the main object of the present invention to provide a cushion which provides good ventilation and eliminates heat concentrations.

Another object of the present invention is to provide a cushion having a smooth upper surface area of sufficient flexibility to fit the curvature of the human body and thereby make people feel comfortable sitting or lying thereon.

DESCRIPTION OF THE PREFERRED EMBODIMENTS

Figure 1:
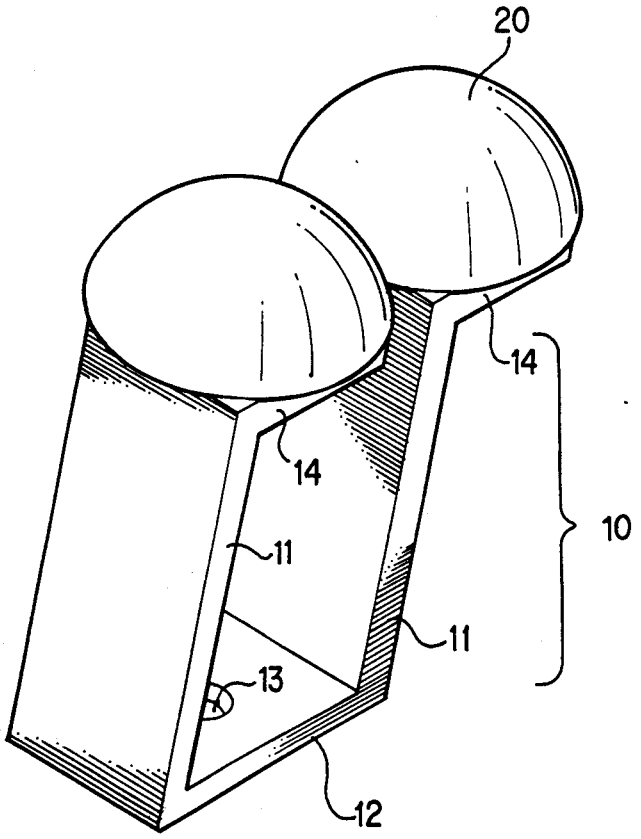
FIG. 1 is a schematic view, illustrating the structure of the spring plate and the connected spherical elemetns.
Figure 2:
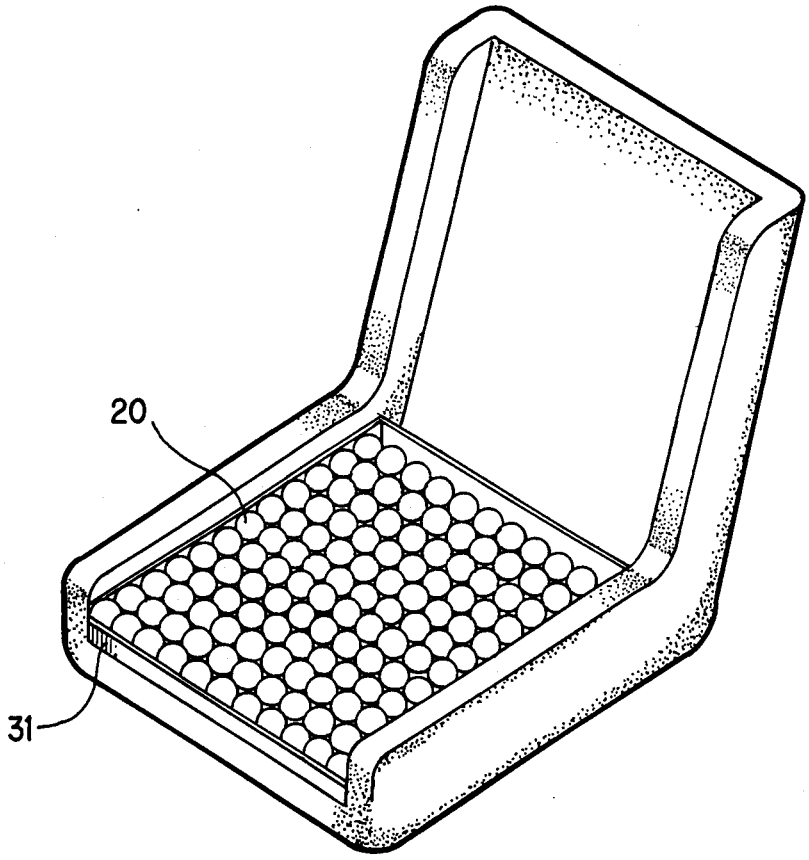
FIG. 2 is a perspective view of a seat cushion embodying the present invention.

Referring to FIGS. 1 and 2, there is shown a substantially U-shaped spring plate (10) having a pair of inclined side plates (11) disposed in spatial parallel relation with one another defining a base (12) therebetween disposed at the bottom end thereof. A hole (13) is formed through the base (12) at a suitable location for fixation. Upper portions of both of the two inclined side plates (11) are transversely directed toward the direction of inclination of side plates (11), to form a pair of flat planes (14) onto which a pair of spherical elements (20) are respectively attached. Each spherical element (20) is provided with a smooth surface and an oval configuration which is slightly larger in dimension than that off a respectively flat plane (14). Each spherical element 20 includes a flat bottom surface which may be fixedly coupled to a respective flat plane (14) of an inclined side plate (11) either by means of adhesive or other suitable fastening means.

A plurality of spring plates (10) are closely arranged to cover a cushion body and to be fixedly coupled thereto by means of suitable fastening means through respective holes (13) formed in the base portions (12). The spring plates (10) are arranged such that all the side plates (11) are inclined toward the rear, with all of the spherical elements (20) slightly in contact with one another at their bottom edge, to form an upper surface of continuous beads.

The cushion body used may be comprised of elastic material, such as rubber, sponge, or the like, to make it more comfortable. Additionally, a suitable helical spring arrangement may be suitably positioned between the cushion body and the underside of the rear-most flat planes (14) of inclined side plates (11) for aiding the U-shaped spring plates (10) and the spherical elements (20) return to their original position after a pressing force has been released therefrom.

Figure 3A:
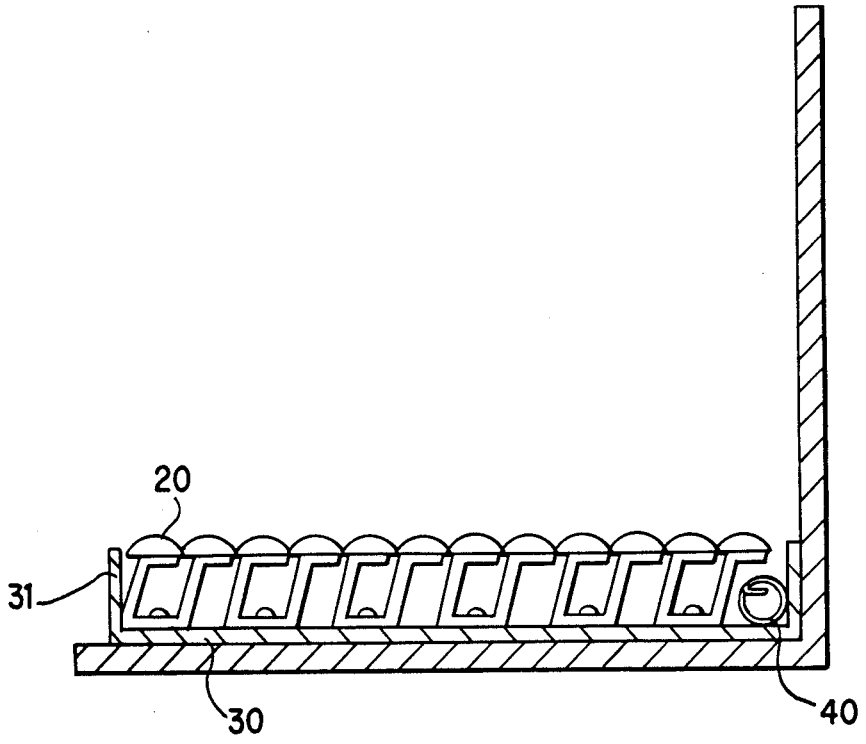
FIGS. 3A and 3B are elevated sectional drawings of the embodiment of FIG. 2; and, FIG. 4 is an elevated sectional view of another embodiment of seat cushion constructed according to the present invention.

With reference of FIG. 3A, there is shown an orthopedically engineered seat constructed according to the present invention, in which the spherical elements (20) are fixedly mounted on the flat planes (14) of the spring plates (10). The spring plates (10) are fixedly mounted on the cushion (30) with the respective side plates (11) inclining back toward the rear of the seat. The spherical elements (20) are respectively disposed in contact with one another to form a surface of substantially continuous beads. According to this embodiment, the periphery (31) of the cushion (30) is made of an elastic material, with a suitable gap being maintained between the back row of spherical elements (20) and the back edge of the cushion (30). Further, suitable helical spring means (40) may be disposed at the back side of the cushion (30) and arranged between the respective flat planes (14) and the cushion (30). Therefore the whole structure provides a cushion which is very smooth and comfortable, and also provides good ventilation.

Figure 3B:
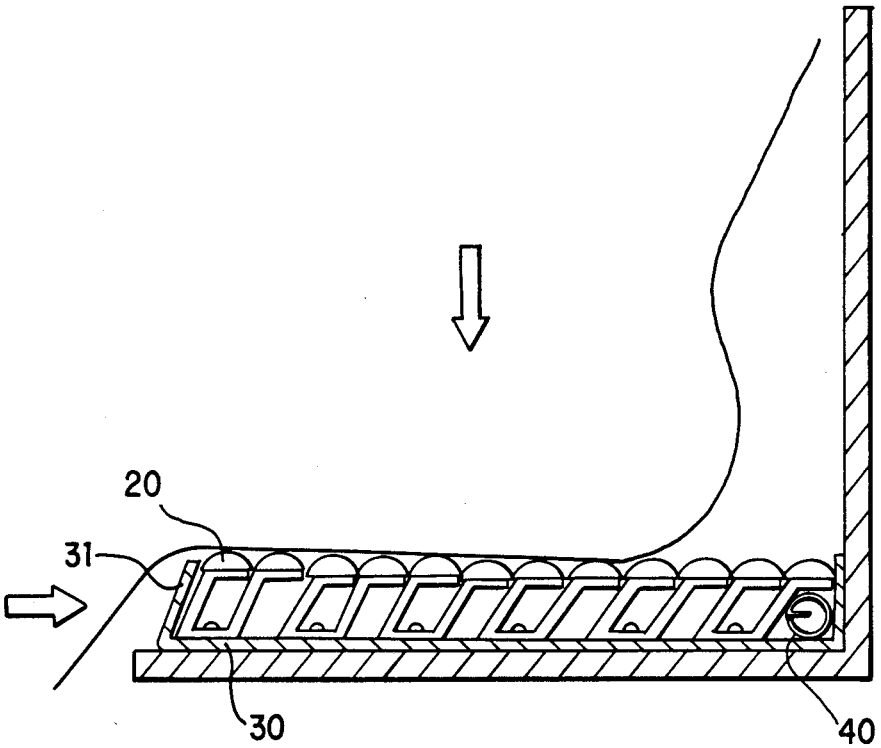

Referring to FIG. 3B, when one is sitting on the seat, the spherical elements (20), in the area where one is seated, are displaced to cause the spring plates (10) to further incline rearwardly one after another. Through this chain reaction, the spring plates (10) in the area of the user will all be displaced rearwardly to perfectly fit the curvature of the person's body who sits thereon. in addition to the good ventilation effect thus provided, the spring plates (10), which are made of a metal material, also serve to eliminate concentrations of heat in the area where one is sitting by virtue of their heat conduction.

Figure 4:
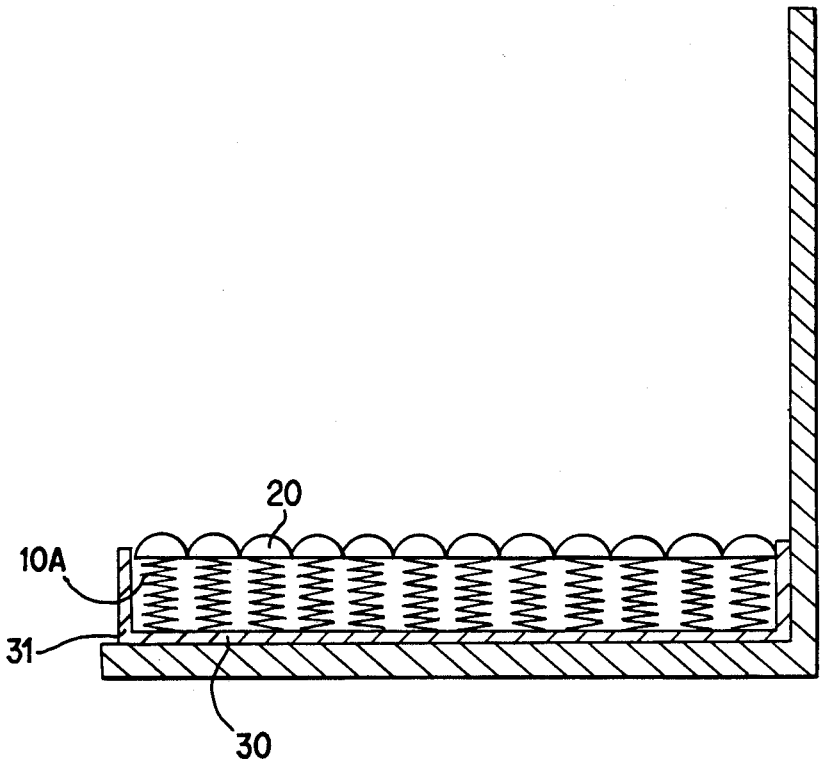

Referring to FIG. 4, there is shown another embodiment of seat cushion constructed according to the present invention. As an alternate form, compression springs (10A) or other suitable spring means may be disposed beneath the spherical elements (20), in lieu of the spring plates (10) used in the first embodiment of FIGS. 1-3. The compression springs (10A) flexibly support the spherical elements (20) and provide an improved ventilation effect.

In addition to serving as seat cushion, the structure disclosed herein may be used for making a mattress for a bed or the like. More particularly, when used in the hot summer season, the advantage of good ventilation and the feature of eliminating concentrations of heat will be much appreciated. When a cushion embodying the inventive concept is directly mounted on a chair, the chair will become very comfortable for use in the summer. As a seat cushion in a car, such will provide the driver or passenger with the same comfortable effect as an air-cushioned seat. When the disclosed structure is used as a mattress for a bed, the structure will provide the ability to automatically adjust to perfectly fit the curvature of the person's body who lies thereon by virtue of different pressures being applied to particular spring plates 10. Thus, there is provided a cushion which is very practical to use, provides good ventilation, and aids in eliminating concentrations of heat.

I claim:

1. A cushion, comprising:

a cushion body formed of an elastic material;

a plurality of spring plates fixedly coupled within said cushion body, each of said spring plates being formed to a metal material composition and having a substantially U-shaped configuration, each of said plurality of spring plates comprising a pair of inclined side plates disposed in spaced parallel relation one to the other defining a base portion therebetween, said base portion being disposed at a bottom portion of said side plates and having a hole formed therethrough at a predetermined position for fixation of said spring plate, said pair of inclined side plates each being inclined in a predetermined direction and having an upper portion transversely directed in said predetermined direction to define a respective pair of flat planes;

a plurality of pairs of spherical elements fixedly coupled to respective pairs of said flat planes of said plurality of spring plates, each of said plurality of spherical elements having (1) a smooth surface and an oval contour, and (2) a substantially flat bottom surface having dimensions of greater value than corresponding dimensions of said flat planes, said flat bottom surface being fixedly coupled to a respective flat plane of one of said inclined side plates;

means for fastening said plurality of spring plates within said cushion body, said fastening means coupling each of said spring plates through said hole formed in said base portion of said spring plate, said spring plates being disposed in spaced relation wherein a bottom peripheral portion of each of said spherical elements is in respective contact with bottom peripheral portions of respective adjacent spherical elements to form an upper surface of substantially continuous beads.

2. The cushion as recited in claim 1, further comprising a helical spring disposed at a rear portion of said cushion body adjacent a rearmost row of said spring plates for assisting said spring plates to return to a first position subsequent to being displaced to a rearwardly inclined second position.

* * * * *